US005369558A

United States Patent [19]

Munz

[11] Patent Number: 5,369,558

[45] Date of Patent: Nov. 29, 1994

[54] FLUORESCENT LAMP REMOVING DEVICE

[75] Inventor: Willi Munz, San Francisco, Calif.

[73] Assignee: Peerless Lighting Corporation, Berkeley, Calif.

[21] Appl. No.: 149,974

[22] Filed: Nov. 10, 1993

[51] Int. Cl.[5] ..... F21V 17/00

[52] U.S. Cl. ..... 362/375; 362/217; 362/377; 362/330; 362/433; 362/226; 362/376

[58] Field of Search ..... 362/217, 220, 225, 306, 362/377, 376, 326, 327, 330, 339, 344, 355, 366, 457, 458, 433, 375

[56] References Cited

U.S. PATENT DOCUMENTS

| | | | |
|---|---|---|---|
| 2,228,646 | 1/1941 | Summers | 362/217 X |
| 2,268,446 | 12/1941 | Gaynor | 362/217 X |
| 2,446,461 | 8/1948 | Diver | 362/217 X |
| 2,525,556 | 10/1950 | Marchisio | 362/217 X |
| 2,887,567 | 5/1959 | Dameral | 362/217 X |
| 2,912,568 | 11/1959 | Winkler | 362/375 |
| 3,004,148 | 10/1961 | Rosolia et al. | 362/375 X |
| 3,194,958 | 7/1965 | Schneidermann | 362/376 |
| 3,281,588 | 10/1966 | Spinetta | 362/375 X |
| 3,302,019 | 1/1967 | Menzin | 362/375 X |
| 3,312,817 | 4/1967 | Erhardt et al. | 362/433 |
| 4,054,793 | 10/1977 | Shemitz | 362/330 X |
| 4,473,870 | 9/1984 | Sorenson | 362/226 X |
| 4,514,793 | 4/1985 | Andreasen | 362/377 X |

*Primary Examiner*—Larry Jones
*Attorney, Agent, or Firm*—Donald L. Beeson

[57] ABSTRACT

A retaining device held in a compact, lensed, task lighting fixture operates to retain the lens in the fixture and to facilitate the removal of the fixture's fluorescent lamp which is otherwise difficult to access. The retaining device is comprised of a strip of resilient material having a base end mounted in a fixed position within the fixture, a resilient middle strip portion shaped to extend around the base end of the fluorescent lamp, and an outwardly biased distal end extending to contact and retain the lens in the fixture housing.

7 Claims, 3 Drawing Sheets

FLUORESCENT LAMP REMOVING DEVICE

BACKGROUND OF THE INVENTION

The present invention generally relates to lighting fixtures, and more particularly relates to lensed fluorescent lighting fixtures having limited finger access for the removal of its fluorescent lamp or lamps. The invention finds particular application in situations where the lens element of the fixture and the fixture's fluorescent lamp are in close proximity to each other and where the lens is simply set into, but not physically retained in the fixture housing.

Lensed fluorescent lighting fixtures for task lighting have been designed to efficiently distribute task light to a task area from a very compact, shallow fixture that can be suitably mounted under a counter or other structure above a task area. Such fixtures, which can be adapted to confined spaces such as found in many office furniture systems or mounted to architectural or other furniture elements including mill work, have two particular disadvantages. First, due to the shallow housing, there is very little space between the housing walls and the lamps for finger access, making it very difficult to remove the lamps for maintenance and lamp replacement. Secondly, because the lens is simply inserted up into and operatively set on top of the bottom aperture of the task light housing, the lens can be dislodged from its proper position, and may even be dislodged entirely from the fixture when, for example, maintenance of cleaning persons work around the fixture. A relatively slight movement of the lens will have a detrimental effect on the fixture's designed photometric characteristics; total dislodgment will likely cause damage to the lens.

The present invention overcomes the above-mentioned drawbacks of such a lensed task light by providing a device that retains the lens element of the fixture and which, at the same time, can be used to remove the fixture's fluorescent lamp or lamps without the need for finger access into the lamp cavity of the housing. Using the device of the invention, the lens element of the lensed task light will be retained firmly in its proper position over the housing aperture while at the same time providing a facility for easy removal of the fixture lamps.

SUMMARY OF THE INVENTION

Briefly, the invention involves a device that attaches to the fixture housing, cradles a fluorescent lamp of the fixture, and, at the same time, contacts the fixture lens to provide a retention force on the lens. The device includes a stationary base adapted to be mounted within the lighting fixture in a substantially fixed position adjacent the fixture's fluorescent lamp. A resilient middle strip portion is shaped to extend from this stationary base around the fluorescent lamp so as to cradle the lamp, and an outwardly biased, and preferably inwardly curved distal end extends from the resilient middle portion so as to contact the inside of the lens for providing an outwardly biased retention force against the lens. Lamp removal is accomplished by simply removing the lens and pulling on the distal end of the device. The device can be made of a single bent strip of resilient material, suitably a plastic material which has a width that spans the metal end of a fluorescent lamp without touching the lamp's glass tube. However, it is understood that the device can be otherwise constructed, for example, the device could be a non-unitary element having a separate base, middle portion, and distal end of different materials, provided the middle portion has sufficient resiliency to permit it to be deformed to dislodge the lamp, and provided the distal end which extends to contact the lens is outwardly biased to retain the lens against the fixture housing.

Therefore, it can be seen that a primary object of the invention is to provide a device that has the dual function of retaining the lens of a lensed fluorescent lighting fixture and of facilitating the removal of the fluorescent lamps from the fixture. It is a further object of the invention to provide a device having these combined functions which can be inexpensively fabricated and easily installed. Other objects of the invention will be apparent from the following specification and claims.

DESCRIPTION OF THE ILLUSTRATED EMBODIMENT

DETAILED DESCRIPTION OF THE ILLUSTRATED EMBODIMENT

Figure 1:
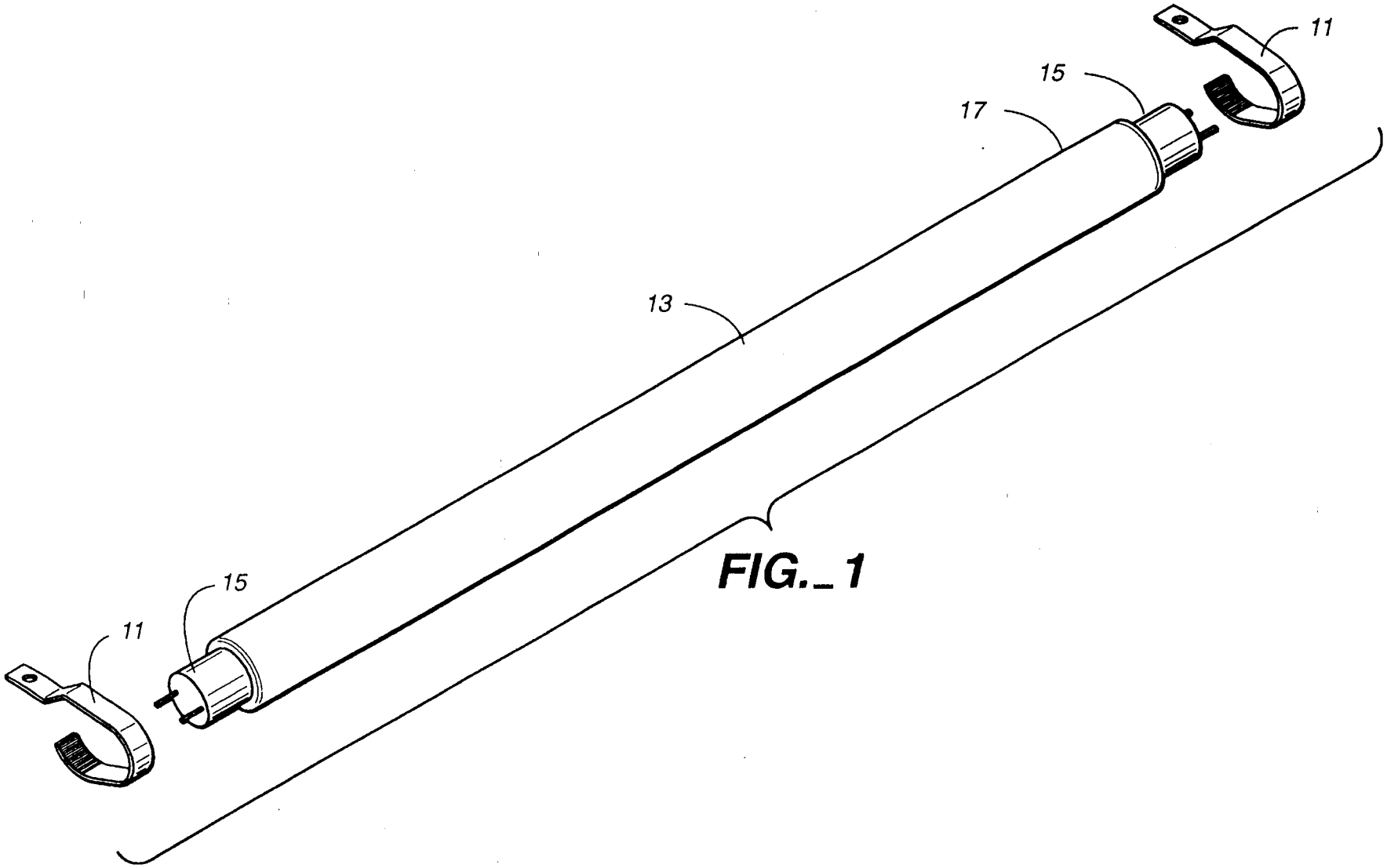
FIG. 1 is an exploded top perspective view of a pair of devices in accordance with the invention showing the relative positioning of the devices at the ends of a fluorescent lamp of the fluorescent task lighting fixture as shown in FIGS. 2–4.

Referring now to the drawings, FIG. 1 shows a pair of retaining devices 11 used with fluorescent lamp 13 such that one retaining device is provided for each of the ends of the lamp. More specifically, the retaining devices are disposed to wrap around and capture the lamp's metal ends 15, with the retaining devices being of a width that will prevent the devices from touching the lamp's glass portion 17.

Figure 2:
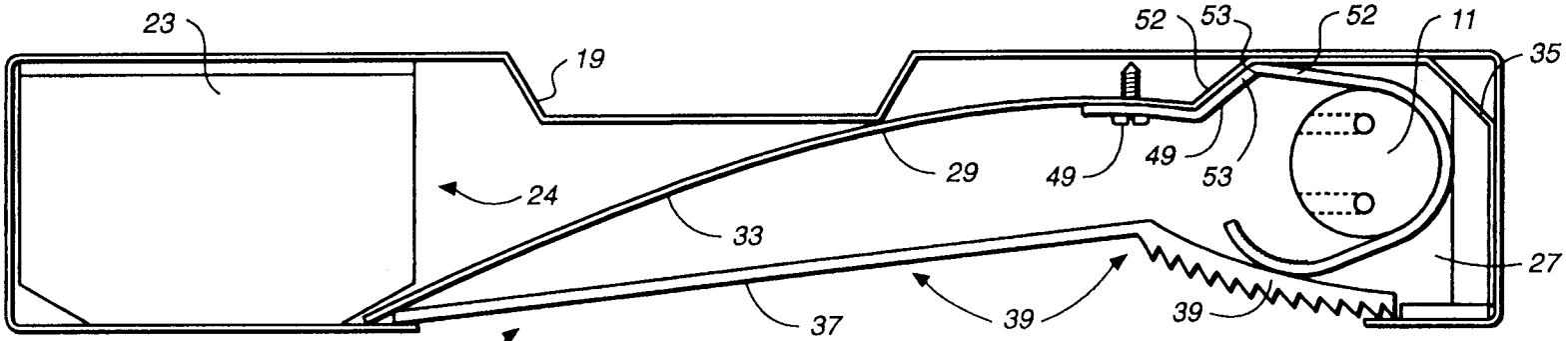
FIG. 2 is a side elevational view in cross-section of a lensed fluorescent task lighting fixture incorporating a device in accordance with the invention.
Figure 3:
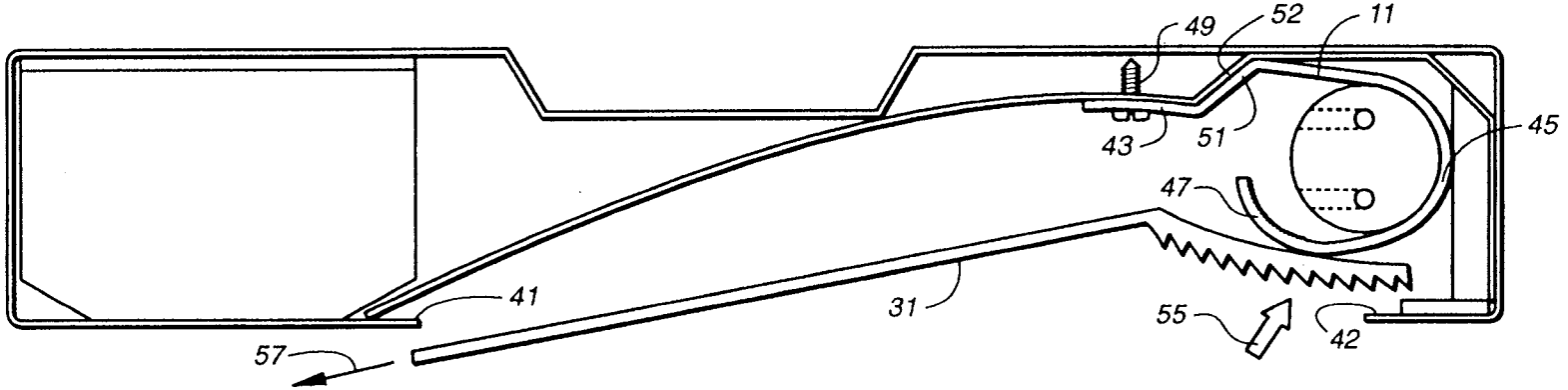
FIG. 3 is a side elevational view in cross-section of the task lighting fixture of FIG. 2 showing the manner of removing the lens element from the fixture.
Figure 4:
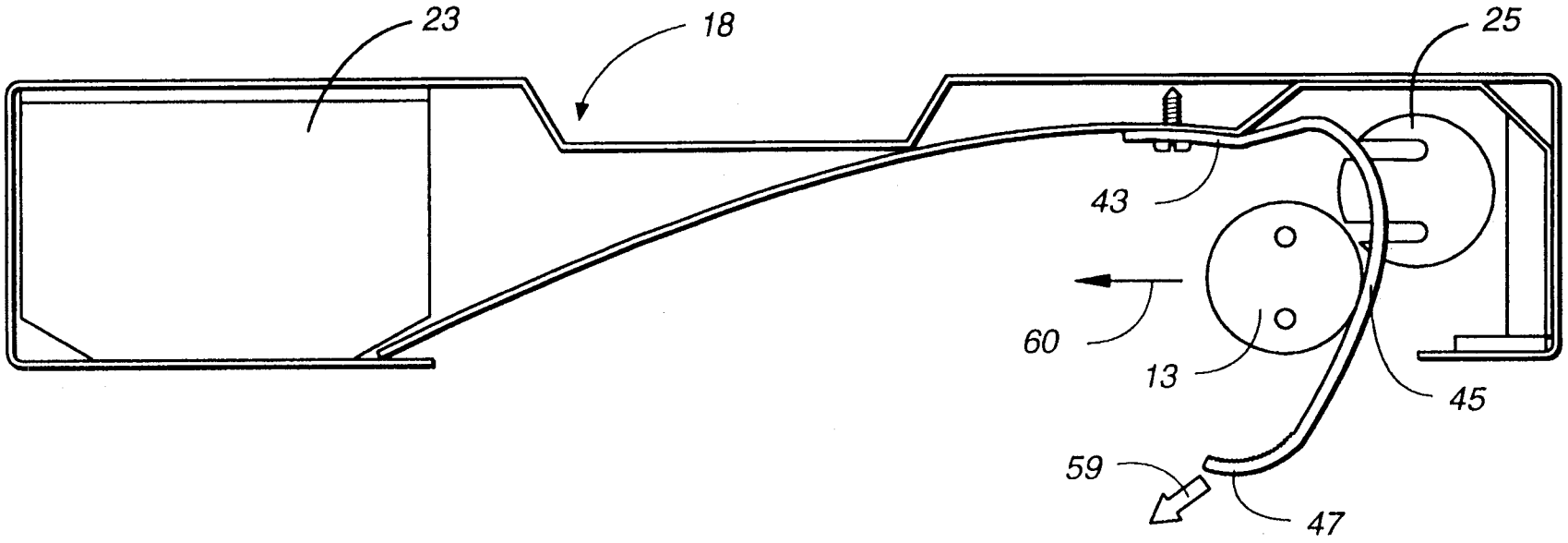
FIG. 4 is a side elevational view in cross-section of the task lighting fixture of FIG. 2 showing the manner in which the fluorescent lamp of the fixture is removed using the device of the invention.

Each of the retaining devices 11 is fabricated of a relatively narrow strip of resilient material such as a UL rated white nylon plastic, and, each is mounted in a compact, shallow lighting fixture as shown in FIGS. 2–4. Referring to FIGS. 2–4, lighting fixture 18 has a housing 19 having a bottom light aperture 21. Ballast 23 is mounted in ballast cavity 24 at the rear of the housing, and fluorescent lamp 15 is held by light sockets (25 in FIG. 4) in the housing's front lamp cavity 27. The fixture's optical elements include a bent reflector 29, which extends from the housing's ballast cavity 24 to and into its front lamp cavity 27, and a lens element 31 covering the housing's bottom light aperture 21. The bent reflector is seen to include a portion 33 having a gradual curve that is optically designed to achieve desired light distribution and brightness characteristics, and a front portion 35 disposed in the lamp cavity 27 for increasing the overall efficiency of the fixture. Lens element 31, which includes the rear planar portion 37 and downwardly curved prismatic front edge portion 39, sets on the inside lateral edges 41, 42 of the housing's bottom aperture without physical attachment or retention other than retention by the device of the invention as hereinafter described. The curved from edge portion of the lens, that is the portion which lies proximate the lamp, is generally designed to control the intense brightness of the lamp in this region of the fixture. For this purpose this front edge portion may include masking (not shown) on its inside surface.

Retaining device 11 is comprised of a stationary base end 43, a resilient middle strip portion 45, and a distal end 47. The middle strip portion extends from the device's base portion around the fluorescent lamp 15 so as to cradle the lamp, and distal end 47 extends from the middle strip portion for contacting the inside of the lens' front edge portion 39. More specifically, it can be seen that the retaining device is a continuous bent strip of resilient material, the stationary base portion of which is attached by screw 49 to the front edge of the curved portion 33 of the reflector. The device is bent at the base end to provide a rear inclined surface portion 51 which conforms to inclined portion 52 of the reflector front cavity portion 35. The device then is bent at 53 such that the middle strip portion 45 extends in a curvature that substantially conforms to the diameter of the lamp 15. The distal end of the device curves inwardly to provide an arcuate surface for contacting the front edge portion 39 of the lens, and, when in contact with the lens, the distal end is outwardly biased to provide a spring-like force thereagainst. This biasing force acts to retain the lens in the housing as shown in FIG. 2.

Use of the retaining device to remove the fluorescent lamp 15 is illustrated in FIGS. 3 and 4. Referring first to FIG. 3, the lens 31 is first removed from the housing by first pushing the front edge portion of the lens 39 against the outwardly biased distal end 47 of retaining device 11 as indicated by arrow 55, and then by dropping the rear edge portion of the lens from the housing as indicated by arrow 57. With the lens removed, the fluorescent lamp is then easily removed as shown in FIG. 4 by pulling on distal end 47 of the retaining device as indicated by arrow 59, which causes the retaining device to deform and thereby dislodge the lamp as indicated by arrow 60. Due to the resiliency of the retaining device, when the distal end of the retaining device is released, the device will return to substantially its original relaxed position for receiving a new lamp. When a new lamp is installed, the lens can be easily replaced by pressing the front edge portion of the lens against the distal end of the retaining device to the position shown in FIG. 3, and then slipping the rear edge of the lens into place over the rear lateral edge 41 of the housing aperture, that is, to a position shown in FIG. 2. As the front edge of the lens is released, the outwardly biasing force of the retaining device will force the lens down into place on the housing.

Therefore, it can be seen that the present invention provides an unique retaining device for the lens of a shallow, lensed fluorescent lighting fixture which can also be used to remove the difficult to access fluorescent lamp of the fixture. While the present invention has been described in considerable detail in the foregoing specification and in the accompanying drawings, it is not intended that the invention be limited to such detail, except as necessitated by the following claims.

What I claim is:

1. A device for retaining a lens element of a lensed fluorescent lighting fixture and for also removing a fluorescent lamp of said lighting fixture which is in close proximity to said lens element, said device comprising a stationary base end adapted to be mounted in a substantially fixed position within the fluorescent lighting fixture adjacent the fixture's fluorescent lamp, a resilient middle strip portion shaped to extend from said base end around said fluorescent lamp for cradling said fluorescent lamp, and an outwardly biased distal end extending from said middle strip portion for contacting the inside of the lens proximate said fluorescent lamp for providing a retention force thereagainst.

2. The device of claim 1 wherein said stationary end, middle portion, and distal end are formed of a single strip of resilient material.

3. The device of claim 2 wherein said strip of resilient material is plastic.

4. The device of claim 1 wherein said distal end curves inwardly of said device to provide an outwardly biased arcuate contact surface for the lens.

5. The device of claim 1 wherein said resilient middle portion has a width sized to fit over the metal end portions of a fluorescent lamp without touching the glass of the lamp.

6. A device for retaining a lens element of a lensed fluorescent lighting fixture and for also removing a fluorescent lamp of said lighting fixture which is in close proximity to said lens element, said device comprising a stationary base end adapted to be mounted in a substantially fixed position within the fluorescent lighting fixture adjacent the fixture's fluorescent lamp, a resilient middle strip portion shaped to extend from said base end around said fluorescent lamp for cradling said fluorescent lamp, and an outwardly biased distal end extending from said middle strip portion for contacting the inside of the lens proximate said fluorescent lamp for providing a retention force thereagainst, said distal end curving inwardly of said device to provide an outwardly biased arcuate contact surface for the lens, said stationary end, middle strip portion, and distal end are formed of a single strip of resilient material, and said middle portion having a width sized to fit over the metal end portions of a fluorescent lamp without touching the glass of the lamp.

7. The device of claim 6 wherein said strip of resilient material is plastic.

* * * * *